United States Patent [19]

Miller

[11] 4,070,595

[45] Jan. 24, 1978

[54] APPARATUS FOR THE ACCELERATION OF IONS IN THE VIRTUAL CATHODE OF AN INTENSE RELATIVISTIC ELECTRON BEAM

[75] Inventor: Robert B. Miller, Albuquerque, N. Mex.

[73] Assignee: The United States of America as represented by the Secretary of the Air Force, Washington, D.C.

[21] Appl. No.: 748,583

[22] Filed: Dec. 8, 1976

[51] Int. Cl.[2] ..... H05H 1/00

[52] U.S. Cl. ..... 313/361; 328/233

[58] Field of Search ..... 313/359, 361, 362; 328/233

[56] References Cited

U.S. PATENT DOCUMENTS

| | | | |
|---|---|---|---|
| 2,627,034 | 1/1953 | Washburn et al. | 313/362 X |
| 3,358,169 | 12/1967 | Garbuny | 313/359 |
| 3,719,893 | 3/1973 | dePackh | 313/359 X |
| 3,887,832 | 6/1975 | Drummond et al. | 313/359 X |

*Primary Examiner*—Palmer C. Demeo

*Attorney, Agent, or Firm*—Joseph E. Rusz; George Fine

[57] ABSTRACT

The acceleration of large numbers of ions to high energies uses an intense relativistic electron beam produced by a vacuum diode. An electron beam radial profile is maintained by a strong longitudinal magnetic field. A virtual cathode, characterized by an electrostatic potential depression whose depth corresponds to the injected electron beam kinetic energy will form. The virtual cathode is caused to move backwards toward the vacuum diode by utilizing the time history of the injected electron beam voltage and current, and by appropriately flaring the drift tube. Ions trapped in the potential well associated with the virtual cathode move with the virtual cathode and are synchronously accelerated.

3 Claims, 6 Drawing Figures

FIG. 1
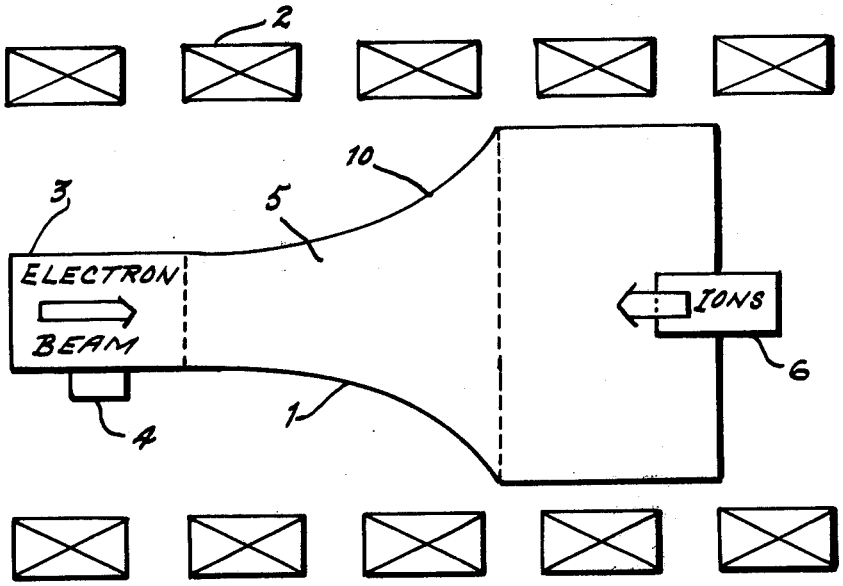
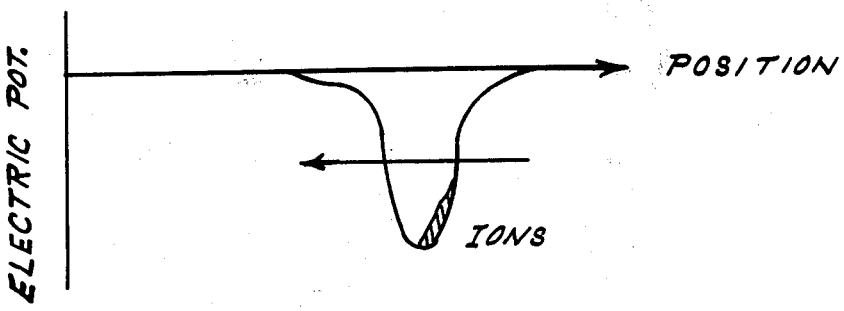
FIG. 2

APPARATUS FOR THE ACCELERATION OF IONS IN THE VIRTUAL CATHODE OF AN INTENSE RELATIVISTIC ELECTRON BEAM

STATEMENT OF GOVERNMENT INTEREST

The invention described herein may be manufactured and used by or for the Government for governmental purposes without the payment of any royalty thereon.

BACKGROUND OF THE INVENTION

This invention pertains to the acceleration of large numbers of ions to high energies using an intense relativistic electron beam. One of the novel features is the controlled motion of ions trapped in a deep potential depression (the virtual cathode) associated with an intense relativistic electron beam by utilizing the time history of the injected electron beam current and voltage, and by appropriately varying the drift tube radius.

The invention offers a convenient and natural method and apparatus for establishing the larger collective accelerating fields associated with an intense electron beam and extending them over relatively large distances. The method and apparatus thereby avoids the difficulties of generating high voltage RF power and the high voltage arcing problems which establish a practical limit for the accelerating fields achieved in conventional linear accelerators (the accelerator operated at the Stanford Linear Accelerator, for example). The invention allows the construction of low cost, lightweight charged particle accelerators for the production of intense, high kinetic energy ion beams.

SUMMARY OF THE INVENTION

Acceleration of ions in the virtual cathode of an intense relativistic electron beam is provided. An electron beam is injected into a flared drift tube having a uniform longitudinal magnetic field. Ions are injected into the tube at the end opposite the electron beam and are trapped in and accelerated by the virtual cathode formed in the tube. One of the novel features of this invention is the controlled acceleration of ions in a virtual cathode with an intense relativistic electron beam by utilizing the time history of the injected beam impedance.

DESCRIPTION OF THE DRAWINGS

FIG. 1 is a schematic of a preferred embodiment allowing acceleration of ions in the virtual cathode of an intense relativistic electron beam;

FIG. 2 is an illustration of the trapped ions in an accelerating virtual cathode;

DETAILED DESCRIPTION OF THE PREFERRED EMBODIMENT

Figure 3A:
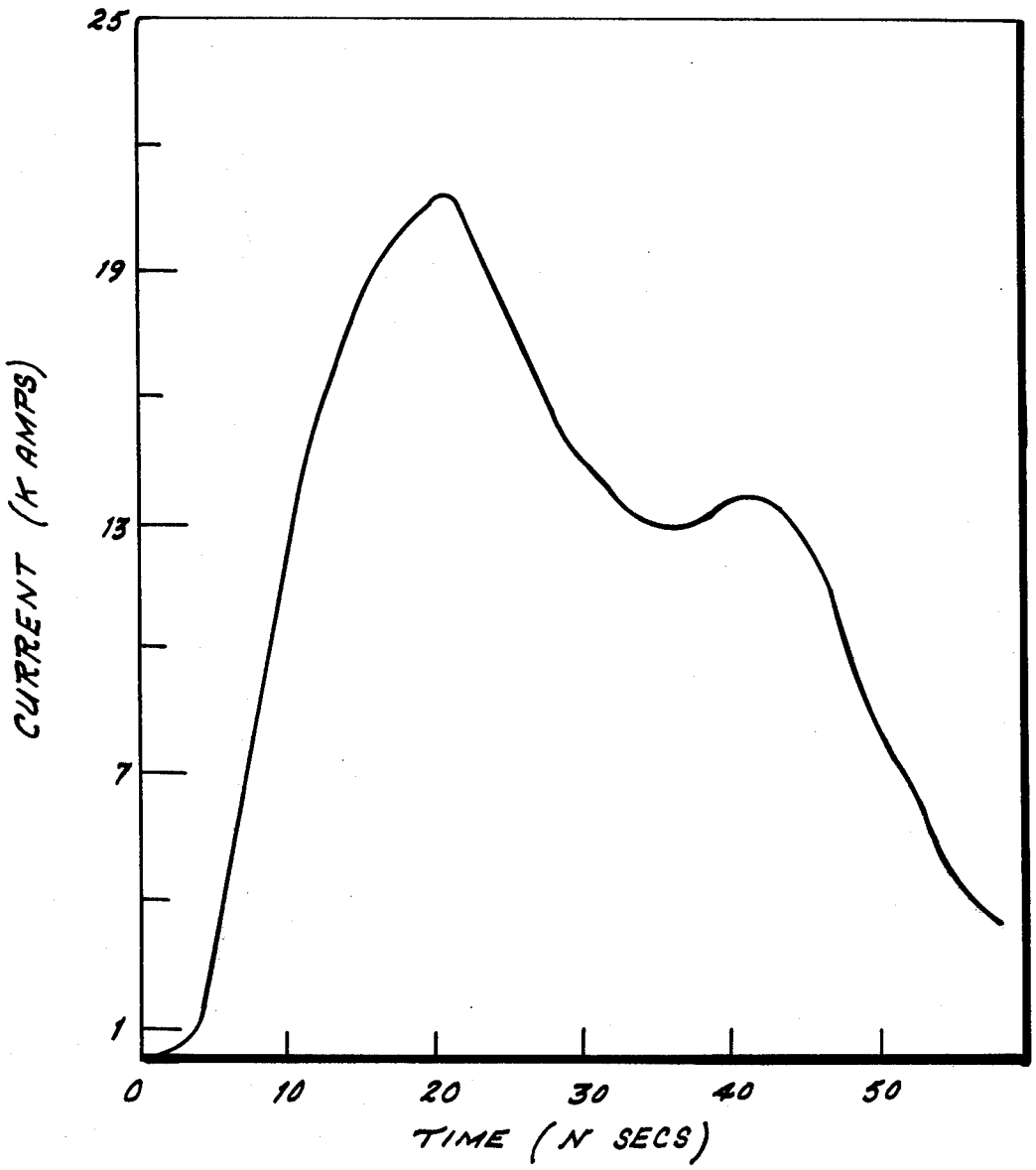
FIGS. 3*a*, 3*b* and 3*c* are illustrations of the typical time history of the diode voltage, current, and impedance, respectively, of an electron beam generator.

When an intense relativistic electron beam is injected into a drift cavity, a self-generated potential difference will exist between the center of the beam and the conducting boundary. If the injected current exceeds the so-called space charge limiting current, the electron beam will have insufficient kinetic energy to overcome the potential barrier and a virtual cathode will form preventing further beam propagation. For a long system (ignoring endplate and anode effects) the necessary condition for virtual cathode formation, including axial and temporal dependence, is given as $$I(z,t) \gtrsim I_1(z,t) = \frac{\left\{[\gamma(z,t)]^{\frac{2}{3}} - 1\right\}^{\frac{3}{2}} \frac{mc^3}{e}}{1 + 2\ln[R(z,t)/r_b(z,t)]} \tag{1}$$

where $I$ is the beam current, $I_1$ is the space charge limiting current, $m$ and $e$ are the mass and charge of an electron, $c$ is the speed of light, $R$ and $r_b$ are the drift tube and beam radii, and $(\gamma\text{-}1)mc^2$ is the electron kinetic energy.

What is desired is controlled movement of the position of the virtual cathode. An examination of Equation (1) indicates that there are four variables that may be changed to produce the desired circumstance. In particular, by holding the radius of the electron beam constant (by applying a strong longitudinal magnetic field) the condition for a moving virtual cathode can be created by using the time history of the electron beam voltage and current (essentially $\gamma$ and I), and appropriately varying the radius of the drift tube. To illustrate the concept, consider the special case in which the beam voltage and radius are held constant, and the beam current and beam radius are allowed to vary. Specifically, consider the situation in which the current rise is linear, i.e., $$I(z,t) = I_0\left(\frac{t - \frac{z}{c}}{t_r}\right); t_r \geqq t - \frac{z}{c}; t - \frac{z}{c} \geqq 0 \tag{2}$$

The condition for virtual cathode formation is then given by $$I_0\left(\frac{t - \frac{z}{c}}{t_r}\right) \geqq \frac{\left(\gamma_0^{\frac{2}{3}} - 1\right)^{\frac{3}{2}} \frac{mc^3}{e}}{1 + 2\ln[R(z)r_b]} \tag{3}$$

Defining $I_{10}$, $h(z)$, and $\alpha$ according to $$I_{10} = (\gamma_0^{2/3} - 1)^{3/2} mc^3/e$$

$$h(z) = [1 + 2\ln(R(z)/r_b)]^{-1} \tag{4}$$

$$\alpha = I_{10}/I_0$$

Equation (3) may be rewritten (assuming equality) as $$z = ct - \alpha ct_r h(z) \tag{5}$$

Equation (5) determines the approximate position of the virtual cathode as a function of time for a given axial variation in drift tube radius (through $h(z)$). Since uniform acceleration of the virtual cathode (toward the anode) is desired, the required variation in $h(z)$ is given by the relation $$ct - \alpha ct_r h(z) = z_1 - 1/2\, a\,(t - t_1)^2 \tag{6}$$

where $z_1$ and $t_1$ (which define the initial position of the virtual cathode) are related according to $$z_1 = ct_1 - \alpha ct_r h(z_1) \tag{7}$$

Solving Equation (6) for $h(z)$ yields the required variation in drift tube radius $$h(z) = h(z_1) + (\alpha ct_r)^{-1}\left\{\left[\frac{2c^2}{a}(z_1 - z_2)\right]^{\frac{1}{2}} + (z_1 - z)\right\} \tag{8}$$

A better understanding of the invention briefly summarized above may be had by the following description. It is to be noted, however, that the appended drawings illustrate only typical embodiments of the invention and are therefore not to be considered limiting of its scope, for the invention may admit to other equally effective embodiments.

Referring to FIG. 1, the design of the accelerator is presented. Vacuum chamber 1, evacuated by vacuum pump 4, constitutes a cylindrically symmetric conducting boundary 10. Electron beam diode 3 establishes the intense relativistic electron beam in ion accelerator section 5. The beam radial profile is held approximately constant by a uniform, static, longitudinal magnetic field produced by magnetic field coils 2. Drift tube boundary 10 in the accelerator section 5 is appropriately flared to allow the formation of a virtual cathode, and the subsequent acceleration of the virtual cathode backward toward the electron beam diode 3. Ion injector 6 is positioned at the end of the accelerator section 5 opposite electron beam diode 3, and provides a source of ions to be loaded into the potential well associated with virtual cathode.

Referring to FIG. 2, ions trapped in the potential depression associated with the virtual cathode are synchronously accelerated as the virtual cathode accelerates backward toward the electron beam source.

Figure 3B:
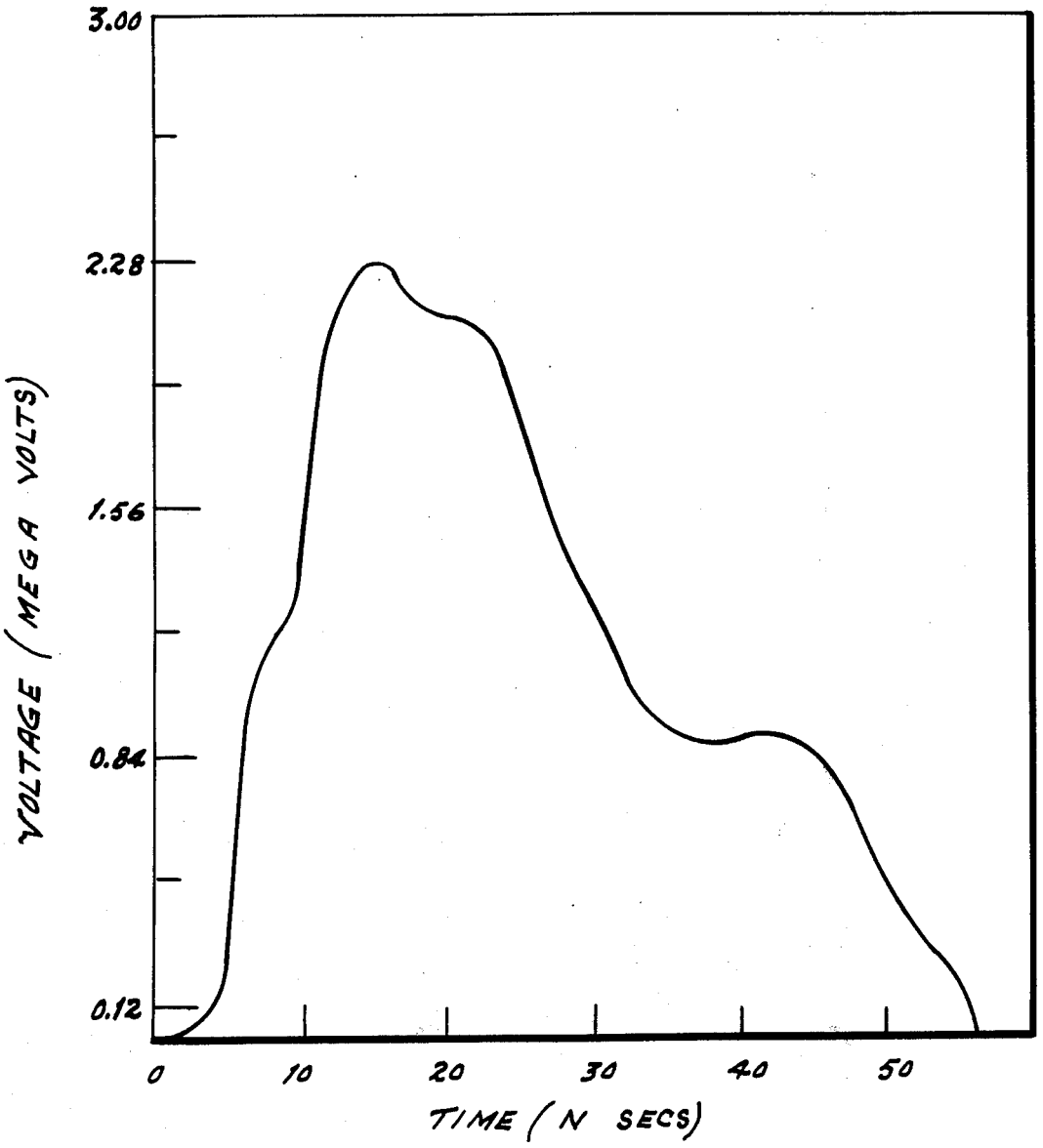
Figure 3C:
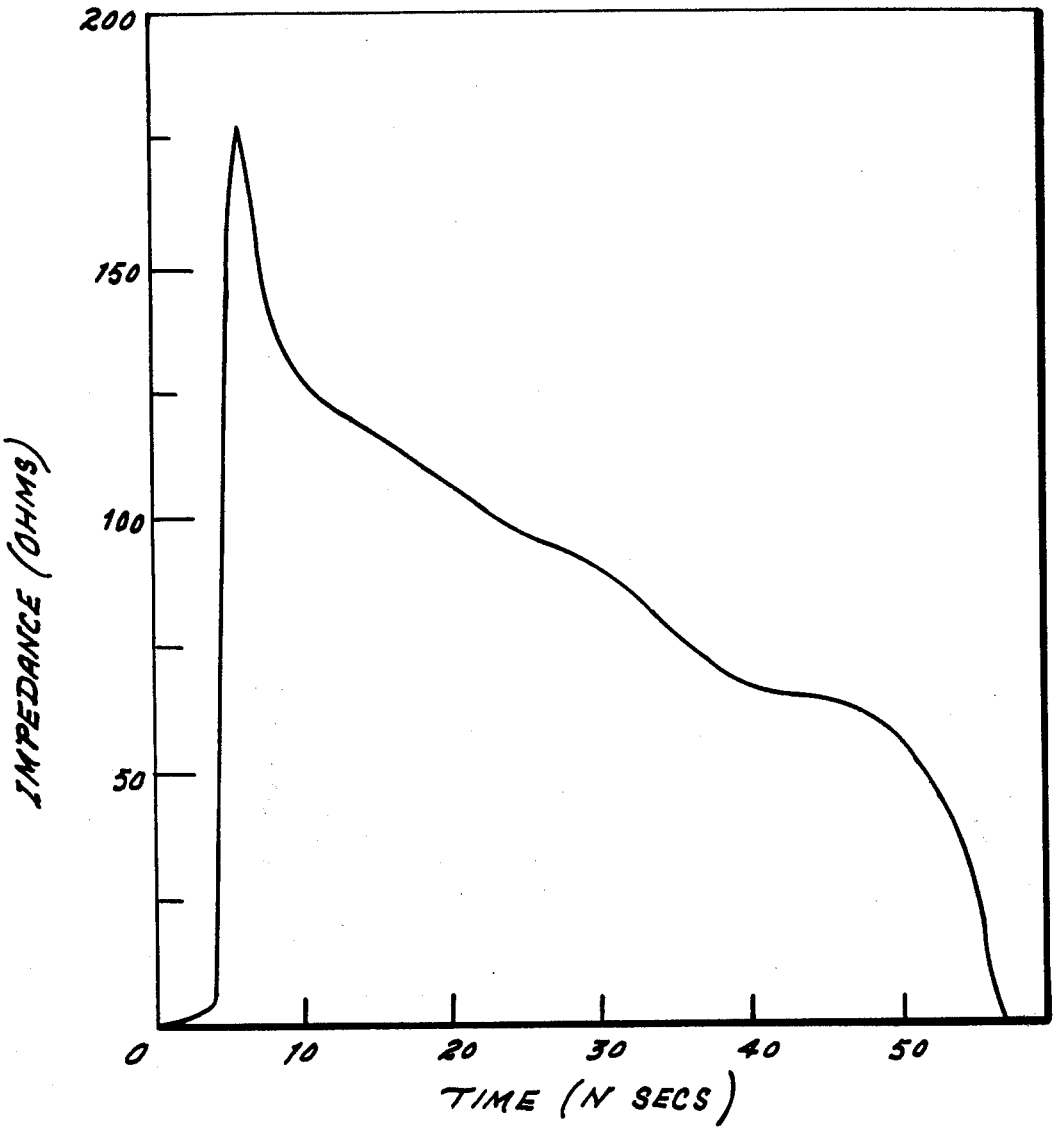
Figure 4:
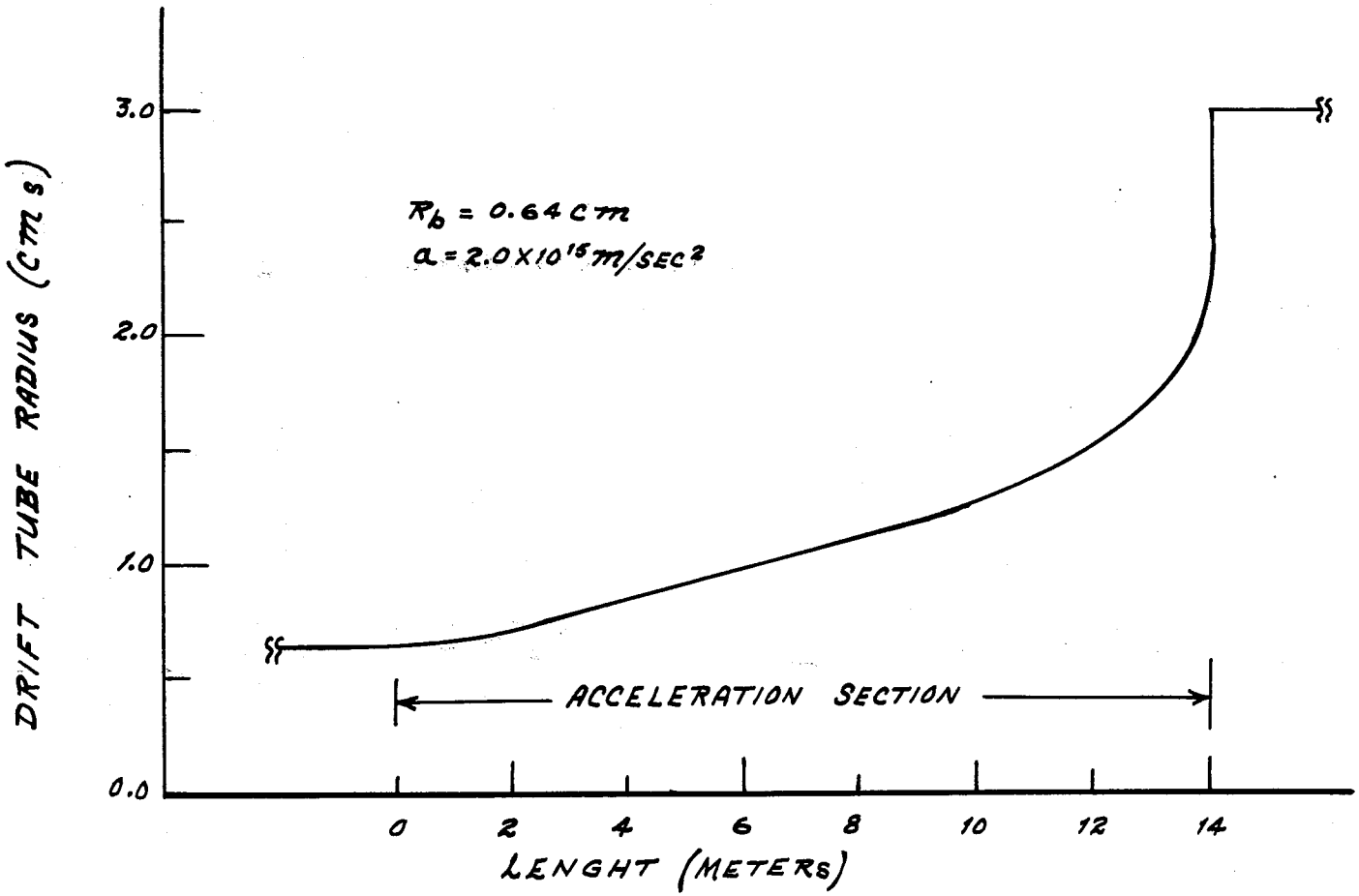
FIG. 4 is an illustration of the drift tube construction required to produce an accelerating virtual cathode based on the voltage and current histories presented in FIG. 3.

The time history of the electron beam pulse presented in FIGS. 3*a*, 3*b* and 3*c* is specifically that of a particular electron beam generator; however, the general behavior of the diode impedance (decreasing over the pulse time) is characteristic of most prior art emission electron beam generators. Using the time history, FIG. 4 presents the computed radius of the accelerator section of the conducting drift tube required to produce a uniform acceleration of the virtual cathode.

What is claimed is:

1. Apparatus for acceleration of ions in the virtual cathode of an intense relativistic electron beam comprised of a drift tube flared a predetermined magnitude at a predetermined position along the longitudinal axis thereof, said drift tube having first and second ends opposite to each other with said second end substantially larger than said first end, means to form an electron beam at said first end, said electron beam being directed toward said second end, an acceleration section adjacent to said means to form said electron beam, said acceleration section being appropriately flared to allow the formation of a virtual cathode and an associated potential well in the region of said second end for subsequent uniform acceleration of said virtual cathode backward toward the electron beam, ion injector means positioned at said second end to provide ions to be loaded into said potential well associated with said virtual cathode for synchronous acceleration backward, and means to establish a uniform, static, longitudinal magnetic field along said drift tube to hold the beam radial profile approximately constant.

2. Apparatus for acceleration of ions as described in claim 1 further including a vacuum pump associated with said drift tube for evacuation thereof.

3. Apparatus for acceleration of ions as described in claim 1 wherein the means to establish a magnetic field is comprised of a series of coils positioned outside of said drift tube and placed along the longitudinal axis thereof.

* * * * *